US005985360A

United States Patent [19]

Boriani et al.

[11] Patent Number: 5,985,360

[45] Date of Patent: Nov. 16, 1999

[54] METHOD FOR THE APPLICATION OF ADHESIVE MATERIAL TO A WRAPPING MATERIAL

[75] Inventors: Silvano Boriani, Bologna; Alessandro Minarelli, Bazzano, both of Italy

[73] Assignee: G.D. S.p.A., Bologna, Italy

[21] Appl. No.: 08/882,331

[22] Filed: Jun. 25, 1997

[30] Foreign Application Priority Data

Jun. 25, 1996 [IT] Italy ..... BO96A0349

[51] Int. Cl.[6] ..... B05D 5/10

[52] U.S. Cl. ..... 427/207.1; 118/314; 427/424; 427/439

[58] Field of Search ..... 427/207.1, 424, 427/439; 118/314

[56] References Cited

U.S. PATENT DOCUMENTS 4,201,150 5/1980 Edwards ..... 118/314 X 5,133,366 7/1992 Liebich ..... 131/70

FOREIGN PATENT DOCUMENTS 523589 1/1993 European Pat. Off. .

4241176 6/1994 Germany .

2093739 9/1982 United Kingdom .

*Primary Examiner*—Bernard Pianalto

*Attorney, Agent, or Firm*—Cushman Darby & Cushman IP Group of Pillsbury Madison & Sutro

[57] ABSTRACT

Adhesive material is directed by two gumming applicators onto selected portions of a wrapping material as it advances in a given feed direction at a predetermined velocity, with no interruption in the movement of the wrapping material. The two applicators make a forward pass and a return pass, each composed of two constituent passes, during the course of which the adhesive material is deposited simultaneously along respective first and second segments of a first trail in the forward direction and in like manner along respective first and second segments of a second trail in the reverse direction; each complete trail extends transversely and substantially across the full width of the wrapping material.

4 Claims, 2 Drawing Sheets

METHOD FOR THE APPLICATION OF ADHESIVE MATERIAL TO A WRAPPING MATERIAL

BACKGROUND OF THE INVENTION

The present invention relates to a method for the application of an adhesive material to a wrapping material.

The invention is employed advantageously in the art field of wrapping machines for cigarettes, an area of use to which reference is made explicitly throughout the following specification, albeit with no limitation in general scope implied.

It is usual in machines of the aforementioned type for the wrapping material to be decoiled from a roll and directed toward a wrapping station, passing through a cutting station and a gumming station; at this latter station, a layer of glue is applied to predetermined areas of the wrapping material in such a manner that the corresponding edges of the cut sheet can be joined subsequently during the step of wrapping the product.

The gumming operation will be effected generally by bringing the material to a standstill at the gumming station long enough for the adhesive to be applied by respective gumming means. The pause made by the wrapping material at the gumming station gives rise to certain drawbacks, chief among which being a reduction in the operating speed of the machine overall, also a jerky movement of the wrapping material that tends to result in an erratic restart after successive applications of the adhesive material, and ultimately in the risk of breakage.

SUMMARY OF THE INVENTION

The object of the present invention is to provide a method for the application of adhesive material to a wrapping material such as will both enable a wrapping material to be advanced at high speeds and allow the gumming operation to be completed with great rapidity, thereby eliminating the drawbacks described above.

The stated object is realized in a method of applying adhesive material to wrapping material, typically in wrapping machines.

Such a method comprises the steps of advancing the wrapping material along a predetermined direction at a predetermined velocity, and applying the adhesive material selectively to at least one portion of the wrapping material at least in one forward gumming pass made along at least one trail, transversely to the direction along which the wrapping material advances. Advantageously, in the method disclosed, the step of applying the adhesive material will be implemented without any interruption in the step of advancing the wrapping material.

The object of the present invention is also to provide a device for the application of adhesive material to a wrapping material.

This same object is realized in a device according to the present invention for the application of adhesive material to wrapping material, typically in wrapping machines, comprising means by which to advance the wrapping material along a predetermined direction at a predetermined velocity; also gumming means consisting in at least one applicator disposed and embodied in such a way as to apply the adhesive material selectively to at least one portion of the wrapping material at least in a single forward gumming pass made along at least one single trail extending transversely to the direction along which the wrapping material advances, the adhesive being applied by the gumming means simultaneously with and without interrupting the advance of the wrapping material.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS

Figure 1:
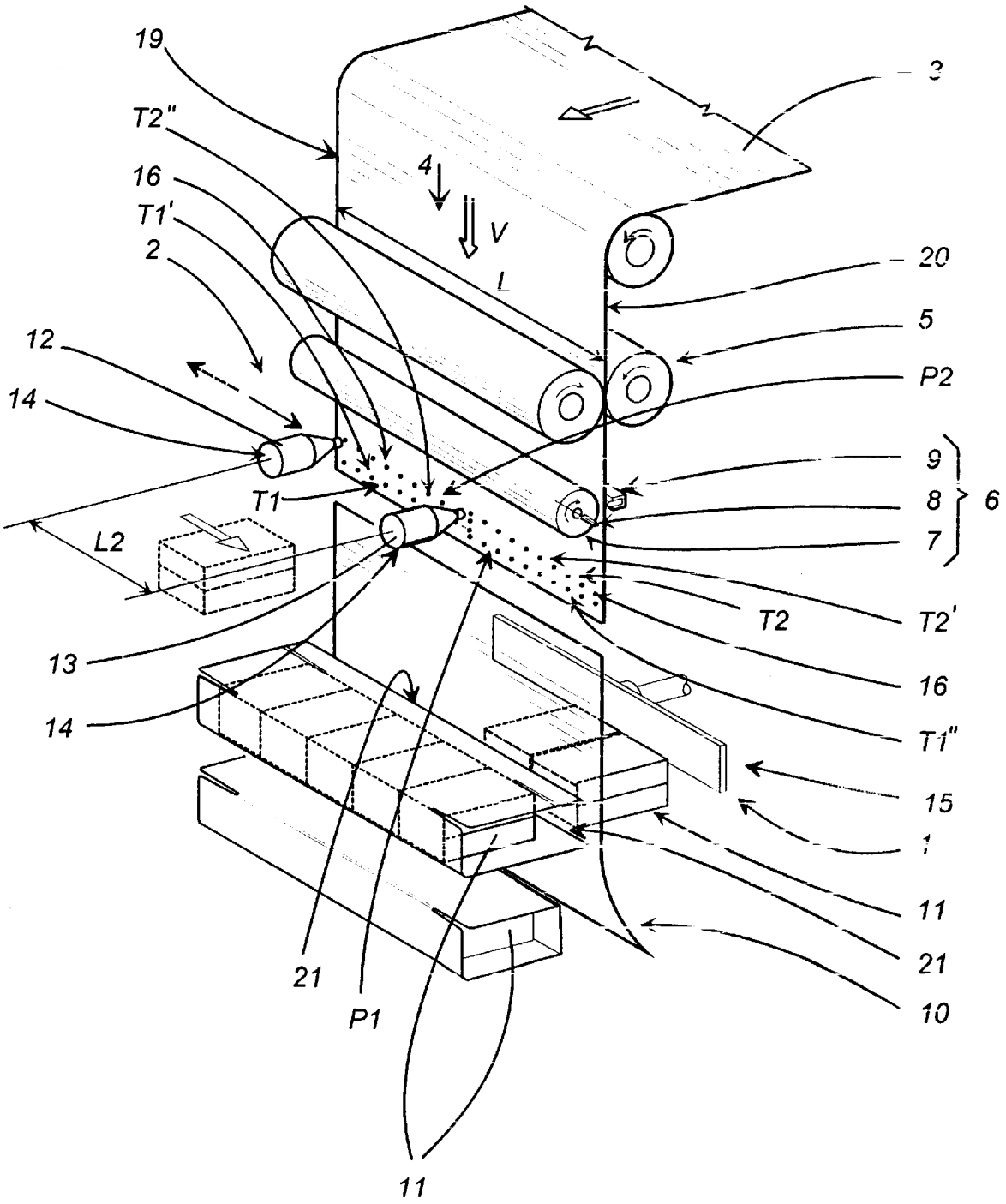
FIG. 1 illustrates a preferred embodiment of a device for the application of adhesive material according to the invention, viewed schematically in perspective and with certain parts omitted for clarity.

With reference to FIG. 1 of the drawings, the numeral 1 denotes part of a wrapping machine, in its entirety, and the numeral 2 denotes a device, likewise in its entirety, for the application of adhesive material 16 to a wrapping material 3.

The wrapping material 3 is made to advance at a given linear velocity V along a feed path extending in a predetermined direction denoted 4, drawn forward by a pinch roll device 5 of conventional embodiment followed in the feed direction by a cutter unit 6 composed, for instance, of a roller 7 supporting a first blade 8 mounted so as to interact with a second blade 9. Similarly conventional in embodiment, the cutter unit 6 serves to divide the wrapping material 3 into single sheets 10 such as can be folded ultimately around products 11, packets of cigarettes for example, at a wrapping station 15 which is again conventional and will be described no further.

In the example of FIG. 1, the device 2 comprises two gun-type applicators 12 and 13 such as will deposit the adhesive material 16 directly onto selected portions of the wrapping material 3, denoted P1 and P2, which are gummed in such a way that a join (i.e. a joint) can be fashioned between the two transverse edges 21 presented by a single sheet 10 cut from the wrapping material 3 and folded around the products 11. The two applicators 12 and 13, which in the course of the specification will also be referred to respectively as first applicator and second applicator, are disposed in a common plane substantially perpendicular to the plane occupied by the wrapping material 3, set apart at a distance L2 equivalent approximately to half the width L of the wrapping material 3.

Figure 2:
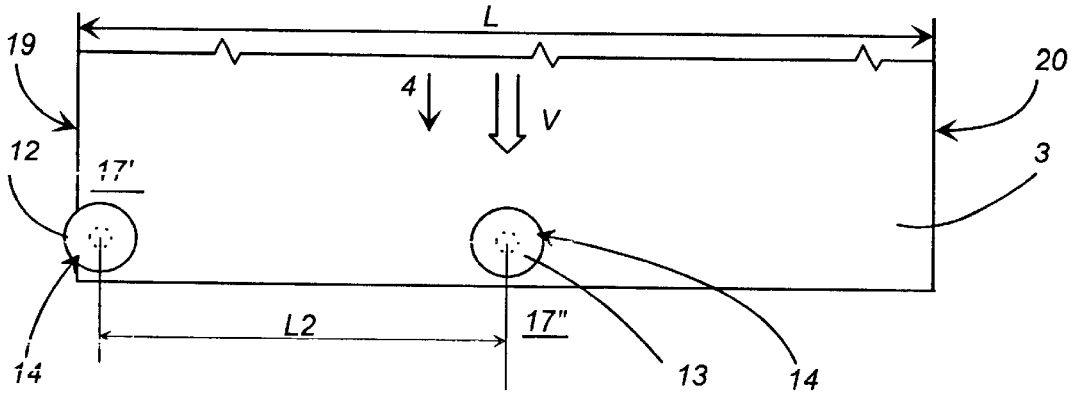
FIGS. 2, 3 and 4 illustrate successive stages in the application of adhesive material to wrapping material as implemented utilizing the method and the device according to the present invention.

Observing FIG. 1 and FIG. 2, the two applicators 12 and 13 are set up in such a way as to make two gumming passes, one forward and one return, during which the adhesive material 16 is applied to the two portions P1 and P2 of the wrapping material 3 along two trails T1 and T2 extending transversely to the feed direction 4 followed by the material 3. The two passes made in applying the adhesive material 16 are brought about simultaneously with the advance of the wrapping material 3, which remains uninterrupted. More exactly, and as discernible from the manner in which the two applicators 12 and 13 are positioned, both mutually and in relation to the advancing wrapping material 3, the forward and return gumming passes are split respectively into two simultaneous constituent (i.e. complementary) forward passes and two simultaneous constituent (i.e. complementary) return passes during which the two applicators 12 and 13 are set in motion transversely to the wrapping material 3 at a forward velocity and a return velocity denoted Vg' and Vg" respectively.

In the case of the forward gumming pass, the first applicator 12 makes a first constituent forward pass during which it proceeds to gum a first half P1/2 of the portion denoted P1 along a first segment T1' representing one component part of the full trail denoted T1. At one and the same time, the second applicator 13 makes a second constituent forward pass during which it will gum a second half P1/2 of the same portion P1 along a second trail segment T1" complementary to the first trail segment T1', with which it combines to complete the relative trail T1.

Likewise in the case of the return gumming pass, the first applicator 12 executes a first constituent return pass and gum a first half P2/2 of the portion denoted P2 along a first segment T2' that represents one component part of the trail denoted T2. At the same time, the second applicator 13 makes a second constituent return pass during which it will gum a second half P2/2 of the selfsame portion P2 along a second trail segment T2" complementary to the first trail segment T2j' with which it combines to complete the relative trail T2.

In operation, the wrapping material 3 is decoiled from a reel (not illustrated) by the action of the pinch roll device 5 and advanced at a predetermined linear velocity V through the cutter unit 6 to the wrapping station 15.

Figure 3:
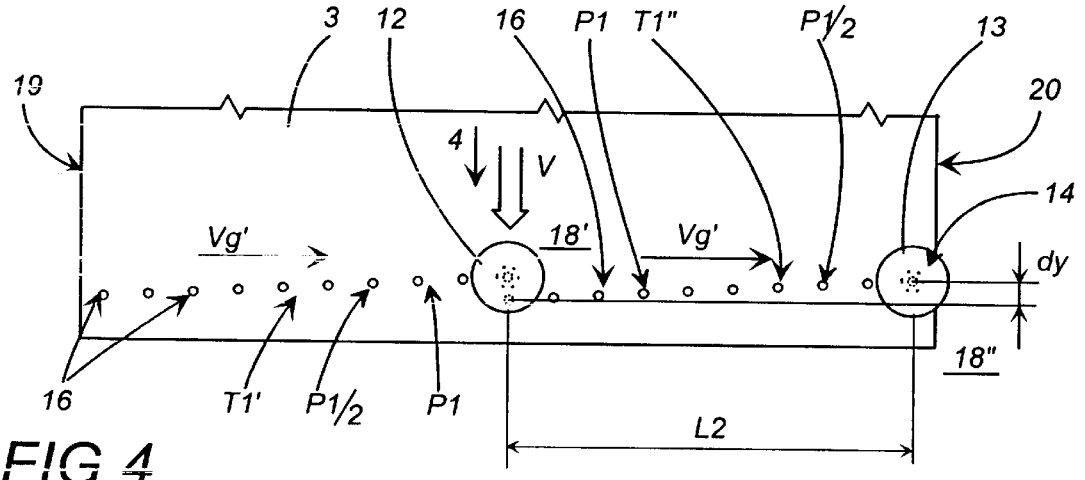
Figure 4:
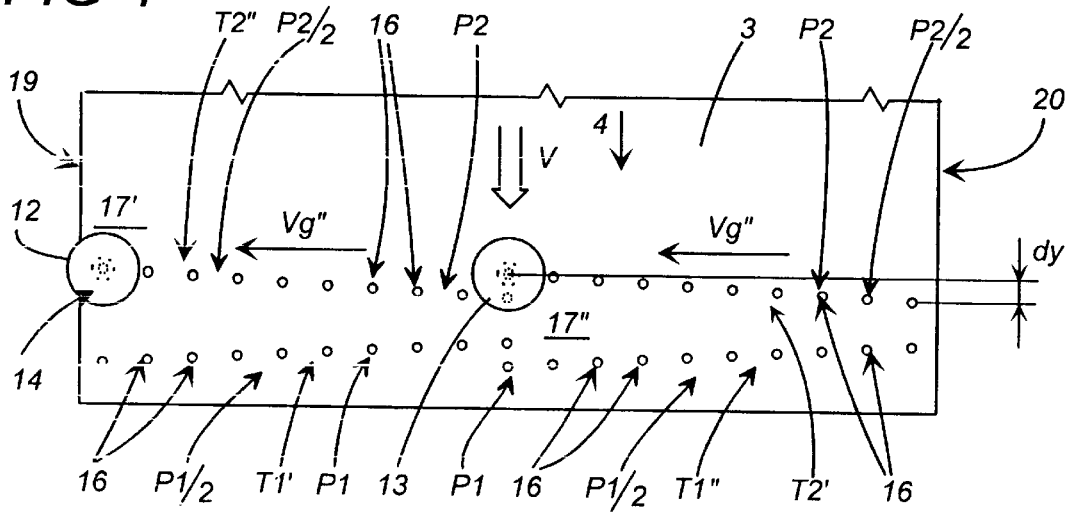

In the solution of FIGS. 2, 3 and 4, the adhesive material 16 is deposited on the wrapping material 16 by two applicators 12 and 13 moving simultaneously in a direction substantially perpendicular to the feed direction 4 and within a plane lying parallel to the plane occupied notionally by the advancing wrapping material 3.

Remembering that the two applicators 12 and 13 are spaced apart at a set distance L2, each one operates within a limited crosswise travel of which the length is also substantially equal to this same distance L2. During the course of their limited crosswise travel, the two applicators 12 and 13 will direct adhesive material 16 onto the respective halves P1/2 and P2/2 making up the portions P1 and P2 of the wrapping material 3 destined to be gummed, in the manner already described.

Thus, the applicators 12 and 13 cover the limited travel distance twice, moving first from left to right (as seen in FIGS. 2, 3 and 4) at a first velocity Vg' to make the forward gumming pass during which adhesive material 16 is applied along the first trail T1, and thereafter from right to left at a second velocity Vg" to make the return gumming pass during which adhesive material 16 is applied along the second trail T2. In a preferred solution the two velocities Vg' and Vg" will be identical.

In the example of the drawings, the applicators 12 and 13 move in the same direction when making the forward and return gumming passes. On the forward gumming pass, the first applicator 12 makes the first constituent forward pass, departing initially from a first start position 17' (FIG. 2) near the left hand side edge 19 of the wrapping material 3 and moving to a second stop position 18' (FIG. 3) near the median line of the wrapping material. The second applicator 13 likewise makes the second constituent forward pass, in this instance departing from a first start position 17" (FIG. 2) near the median line of the wrapping material 3 and moving across to a second stop position 18" (FIG. 3) located near the side edge 20 of the wrapping material 3 remote from the side edge 19 at which the first applicator 12 commences the first constituent forward pass.

The application of adhesive material 16 on the return gumming pass is entirely similar: on the first constituent return pass, the first applicator 12 moves from a first start position 18' (FIG. 3) coinciding with the end of the first constituent forward pass, hence near the median line of the wrapping material 3, to a second stop position 17' (FIG. 4) that coincides naturally with the first start position 17' of the first constituent forward pass. And in the same way, when making the second constituent return pass, the second applicator 13 moves from a second start position 18" (FIG. 3) coinciding with the end of the second constituent forward pass, hence near the right hand side edge 20 of the wrapping material 3, to a second stop position 17" (FIG. 4) near the median line of the wrapping material that coincides naturally with the first start position of the second constituent forward pass.

In an alternative solution, not illustrated in the drawings but equivalent for all practical intents and purposes to that described thus far, the two applicators 12 and 13 are made to move in mutual opposition, for example starting from respective points near the median line of the wrapping material 3 and moving first toward the edges before returning to the middle, or starting from the edges and moving first toward the middle.

Observing FIG. 4, it will be seen that the adhesive material 16 is deposited on the wrapping material 3 by the applicators preferably in intermittent manner so that the gummed areas appear substantially as dotted lines.

Given that the applicators 12 and 13 translate at respective velocities Vg' and Vg" significantly higher than the linear velocity V of the advancing wrapping material 3, the forward trail segments T1' and T1" and the return trail segments T2' and T2" can be generated substantially perpendicular to the feed direction 4.

More exactly, the wrapping material 3 advances during application of the adhesive material 16 through a distance dy that is determined by the velocity V of the wrapping material 3 and by the time needed for the applicators 12 and 13 to gum the selected area. This distance dy in turn determines the angle at which each segment of the gumming trail is disposed relative to a notional line extending perpendicular to the feed direction 4. The use of two or more applicators rather than one only is instrumental in reducing the value of this same distance dy for a given linear velocity of the wrapping material, and therefore in minimizing the longitudinal dimension of the material occupied by the trail T1 (T2) of adhesive material.

Should it be necessary to reduce the distance dy in question or to increase the linear velocity V of the advancing material 3, the number of applicators can be augmented in such a manner as to divide the trail of adhesive material 16 into a greater number of simultaneously generated single segments.

Increasing the number of applicators to three, by way of example, spaced apart uniformly so that each can cover one third of the transverse dimension presented by the wrapping material 3, the distance travelled by the applicators in depositing a full transverse trail of the adhesive material 16 will also be equivalent to one third the width L of the wrapping material 3, so that the time taken by three applicators to gum the selected portion will be less, for a given velocity Vg' (Vg"), than the time taken by two applicators.

We claim:

1. A method for applying adhesive material to a web of wrapping material having a longitudinal, length direction, a transverse, width direction two laterally opposite edges; and two opposite surfaces, comprising the steps of:

(a) advancing the web of wrapping material in said length direction at a predetermined velocity, along a path towards a wrapping station; and (b) at an adhesive applying station located upstream along said path from said wrapping station, while conducting step (a), applying adhesive material to a first transversely extending portion of said web of wrapping material, on one said surface thereof, by moving each of a plurality of adhesive applicators transversely of the web of wrapping material, each across only a respective transversely complementary sub-portion of said first portion, each in one respective pass, while applying therefrom onto said one surface, a respective transversely complementary sub-portion of a first trail of adhesive.

2. The method of claim 1, wherein:

said plurality of adhesive applicators is constituted by two adhesive applicators; and in step (b), said one respective pass of one of said adhesive applicators extends from near one of said edges to generally medially of said web of wrapping material, and said one respective pass of the other of said adhesive applicators extends from generally medially of said web of wrapping material near the other of said edges.

3. The method of claim 1, further comprising:

(c) subsequent to conducting step (b), at said adhesive applying station, and while continuing to conduct step (a), applying adhesive material to a second transversely extending portion of said web of wrapping material which is adjacent to said first transversely extending portion along said path, on said one surface, by moving each of said applicators transversely of the web of wrapping material, each across only a respective transversely complementary sub-portion of said second portion, each in one respective pass, while applying therefrom onto said one surface, a respective transversely complementary sub-portion of a second trail of adhesive;

said moving of step (c) involving moving each of said adhesive applicators in an opposite direction transversely of said web of wrapping material, than in said moving of step (b).

4. The method of claim 3, wherein:

said plurality of adhesive applicators is constituted by two adhesive applicators; and in step (b), said one respective pass of one of said adhesive applicators extends from near one of said edges to generally medially of said web of wrapping material, and said one respective pass of the other of said adhesive applicators extends from generally medially of said web of wrapping material near the other of said edges.

* * * * *